US005425416A

United States Patent [19]

Hammeke et al.

[11] Patent Number: 5,425,416

[45] Date of Patent: Jun. 20, 1995

[54] FORMATION INJECTION TOOL FOR DOWN-BORE IN-SITU DISPOSAL OF UNDESIRED FLUIDS

[75] Inventors: Michael N. Hammeke; Bill Henderson, II, both of Great Bend; Clarence Michael, Pratt, all of Kans.

[73] Assignee: Enviro-Tech Tools, Inc., Pratt, Kans.

[21] Appl. No.: 178,036

[22] Filed: Jan. 6, 1994

[51] Int. Cl.[6] ..... E21B 43/12

[52] U.S. Cl. ..... 166/105.5; 166/108

[58] Field of Search ..... 166/105, 266, 270, 105.4, 166/105.5

[56] References Cited

U.S. PATENT DOCUMENTS

| | | | |
|---|---|---|---|
| Re. 32,866 | 4/1986 | Cruise | 166/310 |
| 1,437,939 | 12/1922 | Green . | |
| 1,675,100 | 6/1928 | Harris . | |
| 2,214,064 | 9/1940 | Niles | 166/1 |
| 2,242,166 | 5/1941 | Bennett | 103/1 |
| 2,946,387 | 7/1960 | Hooker, Jr. | 166/105 |
| 2,986,215 | 5/1961 | Barr | 166/67 |
| 3,167,125 | 1/1965 | Bryan | 166/45 |
| 3,195,633 | 7/1965 | Jacob | 166/42 |
| 3,199,592 | 8/1965 | Jacob | 166/42 |
| 3,333,638 | 8/1967 | Bishop | 166/42 |
| 3,363,692 | 1/1968 | Bishop | 166/42 |
| 3,396,797 | 8/1968 | Little et al. | 166/105 |
| 3,414,057 | 12/1068 | Harbison | 166/105 |
| 3,605,887 | 9/1971 | Lanbie | 166/105 |
| 3,995,691 | 12/1976 | Hedgecock et al. | 166/105 |
| 4,241,787 | 12/1980 | Price | 166/105 |
| 4,296,810 | 10/1981 | Price | 166/265 |
| 4,603,735 | 8/1986 | Black | 166/68 |
| 4,766,957 | 8/1988 | McIntyre | 166/265 |
| 4,880,062 | 11/1989 | Bland et al. | 166/105 X |
| 5,000,264 | 3/1991 | Snider | 166/372 |
| 5,062,480 | 11/1991 | Chacin U. et al. | 166/105 X |
| 5,176,216 | 1/1993 | Slater et al. | 166/105.5 |

OTHER PUBLICATIONS

A.D. Grubb et al "Disposal Tool Technology Extends Gas Well Life and Enhances Profits"1992.

*Primary Examiner*—Ramon S. Britts
*Assistant Examiner*—Frank S. Tsay
*Attorney, Agent, or Firm*—John R. Flanagan

[57] ABSTRACT

A formation injection tool disposable in a casing of a production well includes an intake flow control assembly, a seal mechanism located below the intake flow control assembly, and a discharge flow control device located below the seal mechanism. The intake flow control assembly is attached to a lower end of a pump extending downward within the well casing past and below an upper productive formation. In response to an upstroke of the pump, the intake flow control assembly permits one-way flow of undesired heavier fluid, such as water, from the upper productive formation downwardly and into the intake flow control assembly concurrently as desired lighter fluid, such as oil and/or gas, flows from the upper productive formation upwardly within the well casing to the ground surface. The seal mechanism establishs a closure seal within the well casing between the upper productive formation and lower disposal formation. In response to the downstroke of the pump, the discharge flow control device permits only one-way flow of the undesired heavier fluid from the intake flow control assembly, downwardly through the seal mechanism, and from the discharge flow control device to the lower disposal formation located below the closure seal formed by the seal mechanism.

22 Claims, 3 Drawing Sheets

FORMATION INJECTION TOOL FOR DOWN-BORE IN-SITU DISPOSAL OF UNDESIRED FLUIDS

BACKGROUND OF THE INVENTION

1. Field of the Invention

The present invention generally relates to the separation and disposal of an undesired heavier fluid, such as water, from a desired lighter fluid, such as oil and gas, below ground surface in a production well and, more particularly, is concerned with a formation injection tool for down-bore in-situ disposal of the undesired heavier fluid in the production well.

2. Description of the Prior Art

Oil and/or gas subterranean wells often pass downward through productive formations whose yield, besides a desired lighter fluid, such as oil and/or gas, also includes an undesired heavier fluid, such as water (including salt water). Thus, relatively large quantities of undesired fluid are frequently produced along with the desired fluid. This is particularly true during the latter stages of the productive life of a well. Handling and disposing of the undesired fluid represents a significant expense in the production of desired fluid from these latter-stage wells.

Two basic approaches have been proposed and employed for separation of desired fluid from the undesired fluid and for disposal of the undesired fluid. The first approach, which for the sake of brevity is hereinafter called the "surface" approach, has seen widespread use. The second approach, which for the sake of brevity is hereinafter called the "in-situ" approach, has seen limited use, if any.

The surface approach involves pumping both desired and undesired fluids to above ground surface where they are then separated using various techniques. The separated undesired fluid is then disposed of by first transporting them to and then pumping them downward through a separate costly disposal well and into a subterranean disposal formation. In many cases, especially in latter-stage wells, the surface approach has proven to be too costly to economically produce the desired fluid from these wells, resulting in plugging of the wells and loss of potential revenues and reserves therefrom. Also, pumping the undesired fluid to the ground surfaces raises the potential for adverse environmental impacts during transport and disposal.

The in-situ approach involves separating the undesired fluid from the desired fluid, usually by gravity, in the production well below ground surface. Thus, only the desired fluid is raised to the ground surface, the undesired fluid being separately conveyed downwardly through the well bore and discharged into a disposal formation below the productive formation without first raising the undesired fluid to the ground surface. The in-situ approach has potential advantages and benefits over the surface approach in terms of lower cost and less adverse environmental impacts.

Representative of the production apparatus taking the in-situ approach are the ones disclosed in U.S. patents to Niles (U.S. Pat. No. 2,214,064), Barr (U.S. Pat. No. 2,988,215), Bryan (U.S. Pat. No. 3,167,125), Jacob (U.S. Pat. Nos. 3,195,633 and 3,199,592), Bishop (U.S. Pat. Nos. 3,333,638 and 3,363,692), Price (U.S. Pat. Nos. 4,241,787 and 4,296,810) and McIntyre (U.S. Pat. No. 4,766,957).

U.S. Pat. No. 2,214,064 to Niles discloses a production apparatus located above a packer in a well casing being perforated both above and below the packer. The Niles apparatus includes a lower pump located above the packer, a separator located above the lower pump, and an upper pump located above the separator. The lower pump receives both oil and water from a porous formation above the packer and conveys the oil and water into the separator. The separator causes separation of the oil from the water, conveying the oil upwardly to the upper pump and the water downwardly through the packer, by-passing the lower pump, and into the porous formation below the packer. The upper pump conveys the separated oil from the well.

U.S. Pat. No. 2,986,215 to Barr discloses a salt water disposal apparatus which includes a production standpipe located in a well casing. The standpipe has an outer tube portion being mounted by a pair of spaced upper and lower packers so as to extend below, between and above the packers. The standpipe also has an inner tube portion connected at a lower end to a side of the outer tube for receiving a mixture of water and oil or gas from a formation between the spaced packers and routing the mixture to above the upper packer where the lighter oil or gas rises in the well while the heavier water descends and flows through apertures in the outer tube and then downwardly through the outer tube to a disposal formation located below the lower packer.

U.S. Pat. No. 3,167,125 to Bryan discloses a reciprocal tubular pump disposed in a well casing with its upper end secured to the lower end of a tubing string and its lower end secured to a packer in the well casing. The pump draws in a mixture of oil and water from an annulus between the casing and pump which communicates with the productive formation. The mixture is pumped upwardly to above the pump where the heavier water separates from the lighter oil and flows downwardly through an internal passage within the pump body and through the packer to a disposal formation below the packer.

U.S. Pat. Nos. 3,195,633 and 3,199,592 to Jacob disclose apparatuses for separating and producing oil from water in a well which employs a pair of spaced lower and upper packers and a pair of upper and lower pumps disposed in the well with the lower pump being disposed between the packers and the upper pump being disposed above the upper packer. The upper pump receives lighter oil from a production formation above the upper packer and pumps the lighter oil upwardly to the surface whereas the lower pump receives the heavier water from the formation between the spaced packers and pumps the heavier water downwardly through the lower packer to a disposal formation.

U.S. Pat. Nos. 3,333,638 and 3,363,692 to Bishop disclose apparatuses for disposing of water into a disposal formation located below a production formation by producing a head of water in a tube string above a packer and then, either due to hydrostatic pressure of the head of water or due to a vacuum created below a lower restriction, by forcing or pulling the water downwardly through the packer and into the lower disposal formation.

U.S. Pat. Nos. 4,241,787 and 4,296,810 to Price disclose downhole separator assemblies for separation of oil and water which employ a filter member with membrane sheets operative to separate the oil and water and wherein separated water is then conveyed downwardly through the wellbore and discharged into a disposal formation at a lower elevation below a packer without first raising the water with the oil to the surface.

U.S. Pat. No. 4,766,957 to McIntyre discloses an apparatus for effecting gravitational separation of hydrocarbons and water discharged from a production formation of a subterranean well. The well casing extends downwardly beyond a production zone to a water absorbing zone of the well. A mixture of hydrocarbons and water flows into the interior of the casing through perforations disposed adjacent the production zone. A fluid collection chamber is provided either exteriorly or interiorly of the casing perforations permitting the hydrocarbons to rise to the top of any water. The water flows downwardly, or is forcibly pumped downwardly to the water absorbing formation. The water enters the lower inlet end of the pump and discharges from an upper outlet end thereof. The water discharged by the pump then flows downwardly through a bypass conduit extending downwardly past the exterior of the pump to an inlet to the lower packer where the water then flows through the packer and to the lower water absorbing zone of the well.

While the apparatus of the above-described patents represent a step in the right direction in adopting the in-situ approach of separation and disposal of undesired fluids in the production well, they appear to embody drawbacks in terms of complexity, high cost and serviceability which makes each of them much less than an optimum solution to the problem of cost-effective disposal of undesired fluids. Consequently, a need still exists for an in-situ disposal method which will overcome the drawbacks of the prior art without introducing new ones in their place.

SUMMARY OF THE INVENTION

The present invention provides a formation injection tool designed to satisfy the aforementioned need. The formation injection tool of the present invention is mounted to a bottom-hole tubing pump for carrying out underground separation and down-bore in-situ transport and disposal of the undesired fluids into a disposal formation in the production well.

The formation injection tool of the present invention is cost-effective even in latter-stage wells by minimizing the additional equipment requirements and costs through modification of and use in conjunction with a conventional bottom-hole tubing pump. Thus, the formation injection tool of the present invention only requires modifying and supplementing the bottom-hole pumping equipment in current use rather than requiring the complete replacement of such equipment in order to implement the in-situ approach as appears to be required by the apparatus of the prior art patents.

Accordingly, the present invention is directed to a formation injection tool for use within a casing of a production well in conjunction with a pump having an upstroke and a downstroke and extending downwardly within the well casing past and below an upper productive formation of the production well. The formation injection tool of the present invention comprises: (a) an intake flow control assembly attachable to a lower end of the pump within the well casing and being adapted, in response to the upstroke of the pump, to permit one-way flow of an undesired heavier fluid, such as water, from the upper productive formation downwardly within the well casing and into the intake flow control assembly concurrently as a desired lighter fluid, such as oil and/or gas, flows from the upper productive formation upwardly within the well casing to the ground surface; (b) a seal mechanism located below and attached to a lower end of the intake flow control assembly below the pump, the seal mechanism being adapted to establish a closure seal within the well casing between the upper productive formation and a lower disposal formation of the production well; and (c) a discharge flow control device attached to the seal mechanism and located below the closure seal formed thereby, the discharge flow control device being connected in flow communciation with the lower end of the intake flow control assembly via the seal mechanism and, in response to the downstroke of the pump, being adapted to permit only one-way flow of the undesired heavier fluid from the intake flow control assembly, downwardly through the seal mechanism, and from the discharge flow control device to the lower disposal formation of the production well being located below the closure seal formed by the seal mechanism.

The present invention is also directed to the intake flow control assembly of the formation injection tool which comprises: (a) a main body having a pair of opposite upper and lower ends, a central bore defined in the main body extending axially therethrough between the upper and lower ends thereof, a plurality of inlet ports defined in the main body circumferentially spaced from one another about the central bore of the main body adjacent to the lower end thereof and spaced below the upper end thereof, and a plurality of flow passages defined in the main body extending from the respective inlet ports to the central bore thereof and being connected with the central bore at locations spaced above the lower end of the main body, the upper end of the main body being adapted for attachment to the lower end of the pump; and (b) a plurality of inlet flow control valves coupled to the main body and disposed in flow communication with the inlet ports and flow passages thereof so as to permit one-way flow of the undesired heavier fluid from the productive formation of the well located adjacent to or above the exterior of the main body of the intake flow control assembly into the central bore thereof through the inlet ports and flow passages thereof.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
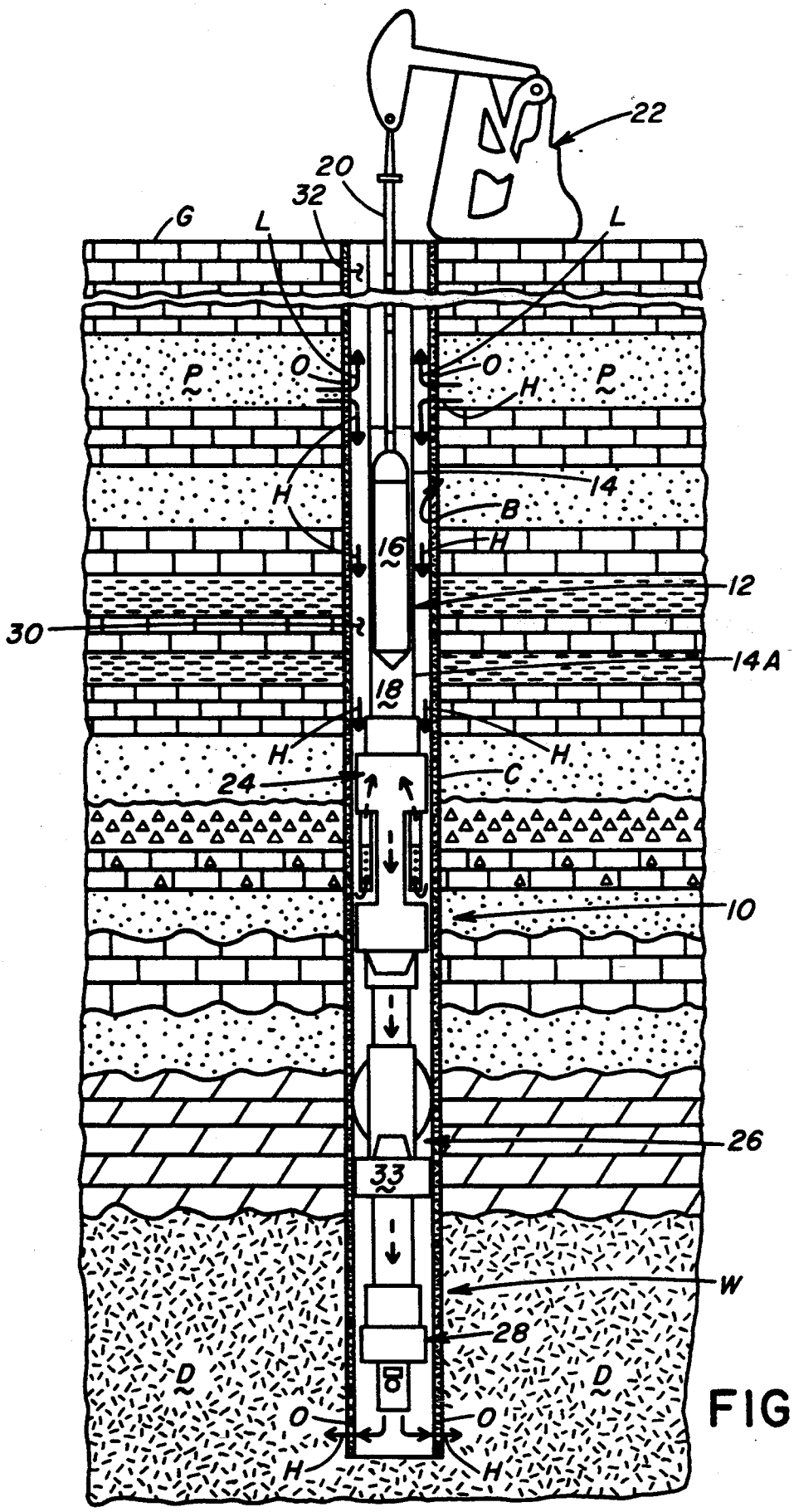
FIG. 1 is a vertical sectional view of a well bore of a production well in which a formation injection tool of the present invention is employed with a conventional down-hole pump.

Referring to the drawings, and particularly to FIG. 1, there is illustrated, in a vertical sectional representation, a well bore B of a production well W formed through an upper productive formation P and a lower disposal formation D and having an elongated tubular production casing C extending downwardly from ground surface G through the upper productive formation P to the lower disposal formation D. Openings O are provided in the casing C at the elevation of the upper production formation P and lower disposal formation D so as to establish flow communication from the respective formations P, D to the interior of the production casing C. The upper productive formation P yields both a desired lighter fluid, such as oil and/or natural gas as represented by arrows L, and an undesired heavier fluid, such as mineral-laden water as represented by arrows H, into the interior of the production casing C.

In accordance with the present invention, a formation injection tool, generally designated 10, is employed in the well bore B for down-bore in-situ transport and disposal of the undesired heavier fluid H from the upper productive formation P to the lower disposal formation D of the production well W. More particularly, the formation injection tool 10 is used in conjunction with a pump 12 having an elongated hollow tube or barrel 14 stationarily mounted within and spaced inwardly from the production casing C and a plunger 16 driven to undergo reciprocal movement within a hollow chamber 18 defined by the elongated barrel 14 of the pump 12. The plunger 16 is reciprocally driven via an elongated sucker rod 20 by a conventional pump drive unit 22 stationed above ground surface G. The plunger 16 is driven by the pump drive unit 22 repetitively through an upstroke followed by a downstroke within the chamber 18 of the pump barrel 14 to carry out, in cooperation with the formation injection tool 10, first, the gravity separation of the desired lighter fluid L from the undesired heavier fluid H and, second, the down-bore in-situ transport and disposal of undesired heavier fluids H to and into the disposal formation D of the production well W. The pump 12 can be any conventional downhole mechanical pump, slightly modified by permanently closing valves (not shown) in the plunger 16 which would not now be used since the plunger 16 is now used solely to pump the undesired heavier fluid H downwardly through the formation injection tool 10 to the lower disposal formation D, instead of pumping the undesired fluid H upwardly to the ground surface G.

Figure 2:
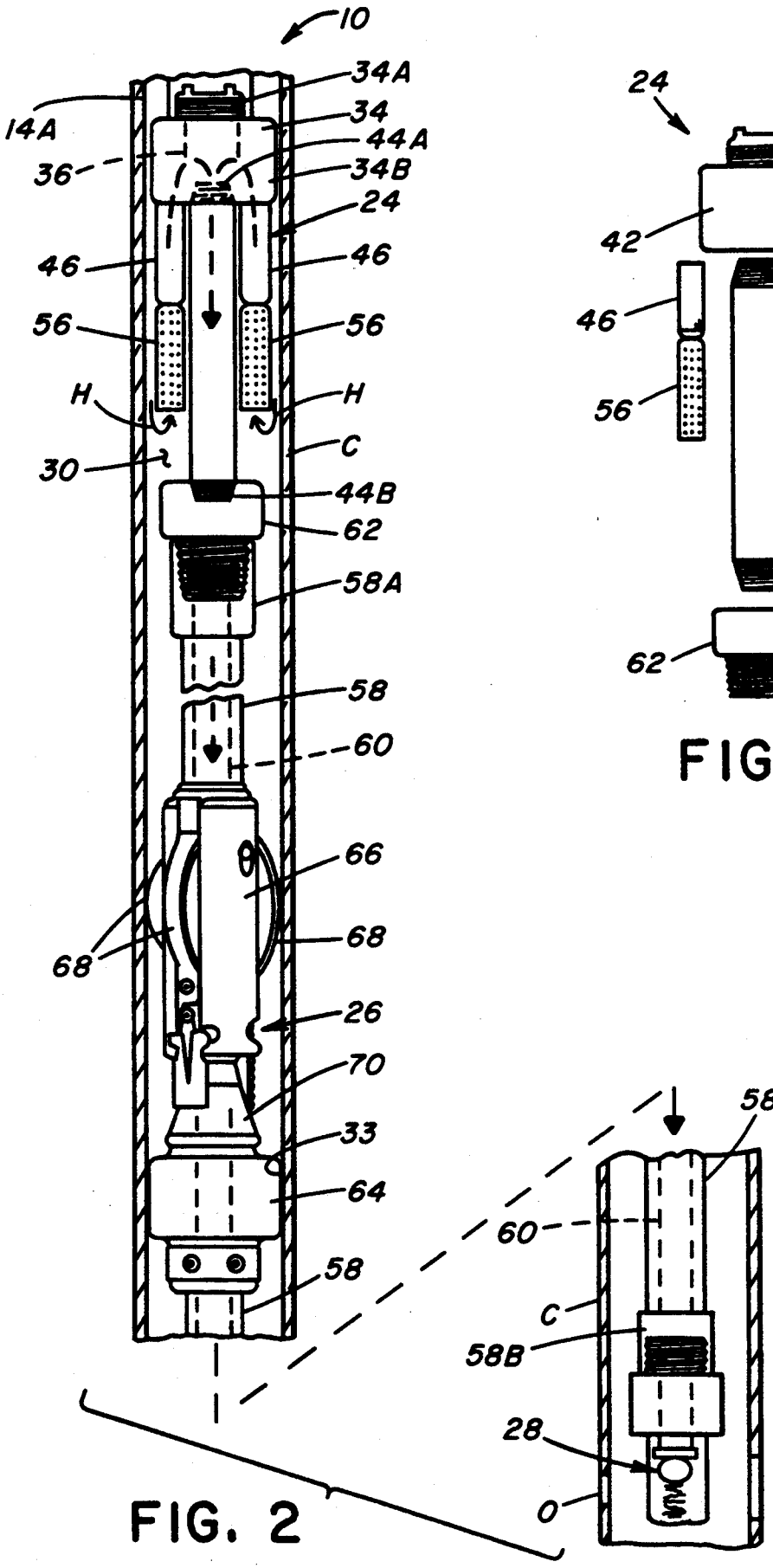
FIG. 2 is an enlarged side elevational view of the formation injection tool of the present invention.
Figure 3:
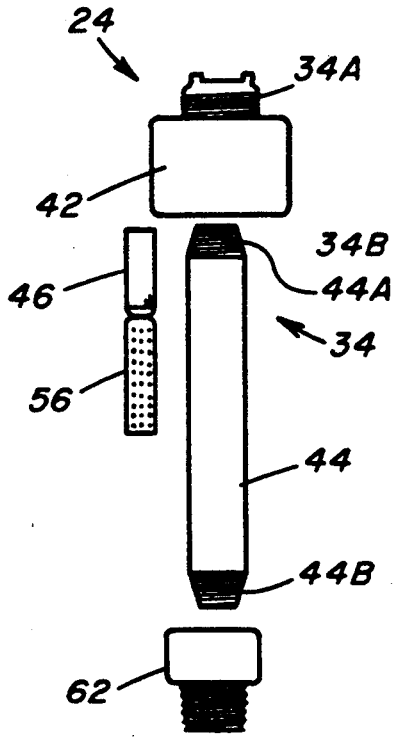
FIG. 3 is an enlarged exploded elevational view of an upper intake flow control assembly of the formation injection tool.

Referring to FIGS. 1 and 2, the formation injection tool 10 basically includes an upper intake flow control assembly 24, a middle seal mechanism 26, and a lower discharge flow control device 28, being arranged in a series or tandem relationship to one another to extend successively downwardly below the pump 12 and within the well casing C below the upper productive formation P of the production well W. The upper intake flow control assembly 24 of the tool 10 is located immediately below and attached to a lower end 14A of the elongated barrel 14 of the pump 12. In response to the upstroke of the plunger 16 within the barrel 14 of the pump 12, the intake flow control assembly 24 is adapted to permit one-way flow of the undesired heavier fluid from the upper productive formation downwardly through a lower annulus 30 between the production casing C and the exterior of the pump 12 and intake flow control assembly 24 (which annulus 30 also extends downwardly to the packing seal mechanism 26), and into the intake flow control assembly 24 and the chamber 18 of the pump. Concurrently therewith, the desired lighter fluid flows from the upper productive formation P upwardly within an upper annulus 32 of the production casing C surrounding the exterior of the pump 12 and extending upwardly to the ground surface G.

The middle seal mechanism 26 of the tool 14 is attached to and located below the upper intake flow control assembly 24 and thus spaced below the pump 12. The seal mechanism 26 is operable to establish an annular closure seal 33 with the production casing C between the upper productive formation P and lower disposal formation D. The annular closure seal 33 thus closes off the bottom of the lower annulus 30. The seal mechanism 26 taken alone or by itself is a conventional commerically available device and so its operation is well-known to one of ordinary skill in this field. The seal mechanism 26 can be any one of several types of seal mechanisms known in this field as "packers".

The lower discharge flow control device 28 of the tool 14 is attached to and located below the seal mechanism 26 and connected in flow communciation with the intake flow control assembly 24 via the seal mechanism 28. In response to the downstroke of plunger 16 within the chamber 18 of the pump 12, the discharge flow control device 28 is operable to permit only one-way flow of the undesired heavier fluid from the intake flow control assembly 24 and the chamber 18 of the pump 12, downwardly through the seal mechanism 26, and from the discharge flow control device 28 to the lower disposal formation D located below the closure seal 34 formed by the seal mechanism 26. Thus, the discharge flow control device 28 is also operable to prevent back flow of the undesired fluid therethrough and upwardly to the intake assembly 24 in response to the next succeeding upstroke of the plunger 16 in the barrel chamber 18 of the pump 12.

Referring to FIGS. 2–5, the intake flow control assembly 24 of the tool 14 includes a main body 34 having a pair of opposite upper and lower ends 34A, 34B, a central bore 36 defined in the main body 34 and extending axially therethrough between the upper and lower ends 34A, 34B thereof, a plurality of inlet ports 38 defined in the main body 34 spaced circumferentially from one another about the central bore 36 of the main body 34 adjacent to the lower end 34B thereof and spaced below the upper end 34A thereof, and a plurality of flow passages 40 defined in the main body 34. The flow passages 40 extend respectively from the inlet ports 38 in an inclined relation inwardly and upwardly to the central bore 36 thereof. The inner ends of the flow passages 40 are connected in communication with the central bore 36 at locations spaced above the lower end 34B of the main body 34.

The main body 34 of the intake flow control assembly 24 is made up of an upper port head 42 and a lower tubular mandrel 44. The port head 42 contains the inlet ports 38, flow passages 40 and a short upper section of the central bore 36. The port head 42 also defines the upper end 34A of the main body 34 which is threaded for attachment to the threaded lower end 14A of the barrel 14 of the pump 12. The tubular mandrel 44 contains most of the central bore 36 of the main body 34. The mandrel 44 is threaded at its opposite upper and lower ends 44A, 44B. At its upper threaded end 44A, the mandrel is threadably received in a threaded central lower socket 42A of the port head 42. The mandrel 44 extends downwardly beyond the inlet ports 38 defined on the lower end of the port head 42 around the central lower socket 42A thereof.

As seen in FIGS. 1–4, the intake flow control assembly 24 also includes a plurality of inlet flow control valves 46 coupled to the main body 34 in flow communication with the inlet ports 38 and the flow passages 40 thereof. The control valves 46 are disposed around the mandrel 44 and extend downwardly from the inlet ports 38 generally parallel to the tubular mandrel 44. The inlet flow control valves 46 are operable to permit one-way flow of the undesired heavier fluid from the productive formation P of the well W located above the exterior of the main body 34 of the intake flow control assembly 24, into the central bore 36 of main body 34 through the inlet ports 38 and flow passages 40 thereof.

Each inlet flow control valve 46 includes a valve cage 48 defining a flow channel 50 extending axially therethrough, an annular seat 52 therein located between opposite ends of the flow channel 50, and a ball 54 movably mounted in an upper portion 50A of the channel 50 defined above the seat 52 to undergo axial movement between an upper opened (unseated) position and a lower closed (seated) position relative to the annular seat 52. Also, a fluid straining cage 56 is connected to a bottom end of each of the valve cages 48 which functions to strain out solid particles above a predetermined size in the undesired fluid H and thus prevent such particles from entering the tool 10.

Thus, the balls 54 of the inlet flow control valves 46 unseat from the seats 52 and move upwardly to their upper opened positions as the desired fluid is drawn into the central bore 36 of the intake assembly 24 and hollow chamber 18 of the pump 12 (from the lower annulus 30 of the well W) by the upstroke of the plunger 16 of the pump 12. Then, at the start of the downstroke of the pump plunger 16, the balls 54 of the inlet flow control valves 46 move downwardly to their lower closed positions in which they are reseated upon the seats 52 as the desired fluid is pushed downwardly from the chamber 18 of the pump 12 and through the central bore 36 of the intake flow control assembly 24, through the seal mechanism 26 and out through the discharge flow control device 28 positioned below the seal mechanism 26. The disposal zone or formation D that the undesired fluid is pumped into is isolated from any upper zones or formations by the annular closure seal 33 of the seal mechanism 26.

Referring to FIG. 2, the middle seal mechanism 26 of the tool 14 includes an elongated hollow body 58 having a pair of upper and lower opposite ends 58A, 58B and a central flow passageway 60 defined through the elongated body 58 and extending between the upper and lower ends 58A, 58B thereof. The upper end 58A of the elongated hollow body 58 of the seal mechanism 26 is threadably interconnected by an annular threaded connector 62 to the lower end 44B of the lower mandrel 44 of the main body 34 of the intake flow control assembly 24.

The seal mechanism 26 also includes an expandable annular member 64 and a guiding member 66 both attached to and disposed about the exterior of the elongated body 58. The guiding member 66 is located adjacent to and above the expandable annular member 64. The guiding member 66 in the form of a plurality of arcuate guide elements 68 which facilitate the insertion and installation of the pump 12 and tool 10 into the well W.

The guiding member 66 also includes a rotatable element 70 threaded about the elongated body 58 and thus movable axially therealong by rotation of the pump 12 and tool 10 during initial installation. Downward movement of the rotatable element 70 causes expansion of the outside diameter of the expandable annular member 64 into engagement with an annular interior surface portion of the well casing C so as to provide the annular closure seal 33 in the well casing C between the upper productive formation P and lower disposal formation D of the production well W. As mentioned above, the seal mechanism 26 is by itself a conventional device and thus the steps in its operation to establish the closure seal 33 are well-known to one of ordinary skill in this field and need not be described in detail herein for obtaining a thorough and complete understanding of the formation injection tool 10 of the present invention.

Referring still to FIG. 2, the lower discharge flow control device 28 of the tool 14 is in the form of a lower one-way check valve 28 connected to the lower end of the elongated tubular hollow body 58 of the seal mechanism 26 and in flow communication with the lower end of the intake flow control assembly 24 via the hollow body 58 of the seal mechanism 26. The lower one-way check valve 28 permits only one-way flow of the undesired fluid from the intake flow control assembly 24 downwardly through the central flow passageway 60 of the seal mechanism 26 and out from the one-way check valve 28 to the disposal formation D located below the closure seal 33 formed in the well casing C by the seal mechanism 26.

Thus, in response to the upstroke of the plunger 16 within the barrel chamber 18 of the pump 12, the undesired heavier fluid is separated from the desired lighter fluid and drawn downwardly through the lower annulus 30 in the production casing C and then through the inlet flow control valves 46 and the inlet ports 38 and flow passages 40 of the main body 34 of the intake flow control assembly 24 into the central bore 36 thereof and into the barrel chamber 18 of the pump 12. On the other hand, in response to the downstroke of the plunger 16 of the pump 12, the undesired heavier fluid in the central bore 36 of the main body 34 of the upper intake flow control assembly 24 and in the barrel chamber 18 of the pump 12 is pushed downward through the central bore 36 and outwardly through the lower end 44B of the mandrel 44 of the main body portion of the intake flow control assembly 24, then through the central passageway 60 of the elongated body 58 of the seal mechanism 26, and finally from the lower discharge flow control device 28 for disposal of the undesired fluid H under pressure in the disposal formation D of the well W. The discharge flow control device 28 functions to prevent back flow of the undesired fluid therethrough and upwardly to the intake assembly 24 in response to the next upstroke of the plunger 16 of the pump 12.

Figure 6:
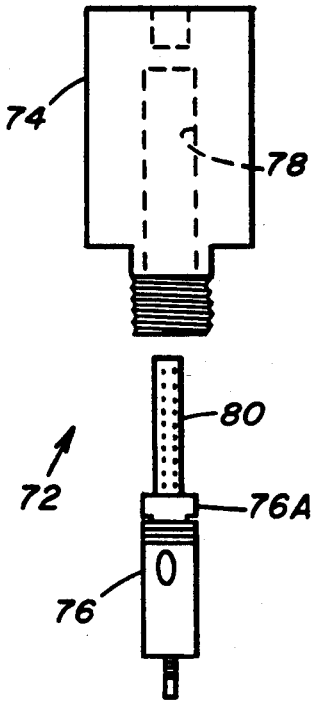
FIG. 6 is an enlarged exploded elevational view of an upper discharge flow control assembly of the formation injection tool.
Figure 4:
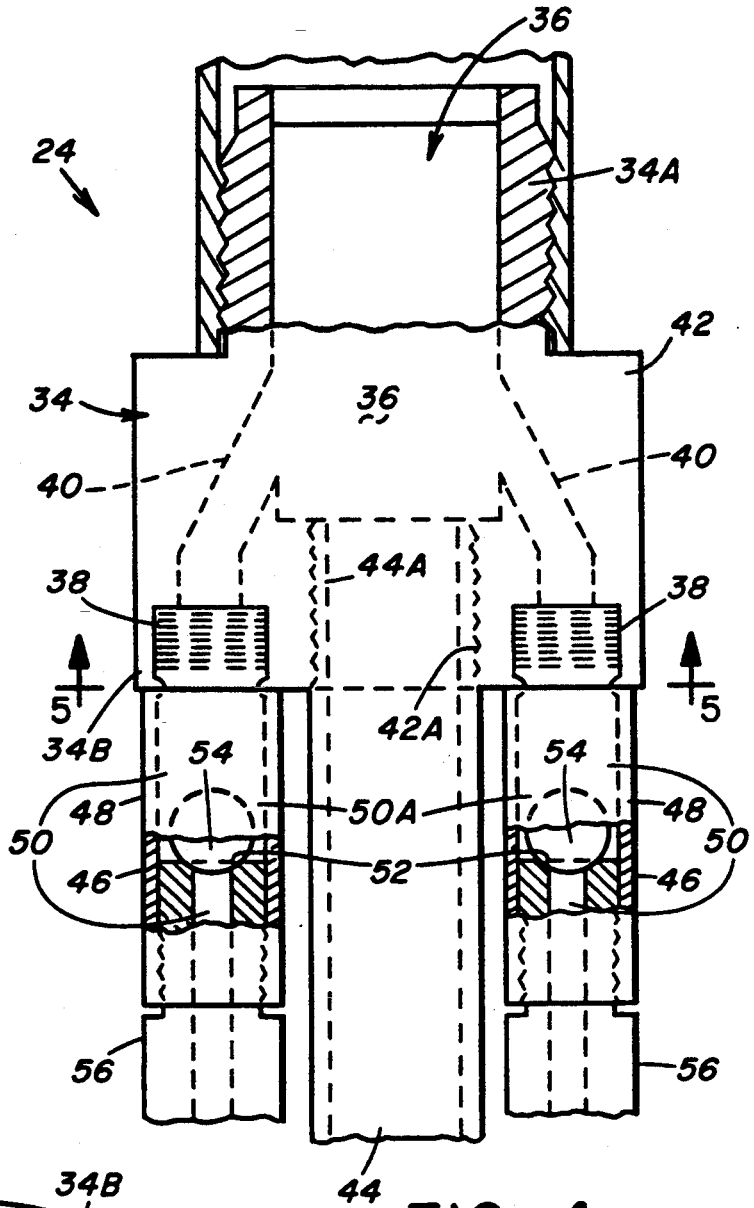
FIG. 4 is an enlarged assembled elevational, partly sectioned, of the intake flow control assembly of FIG. 3.
Figure 5:
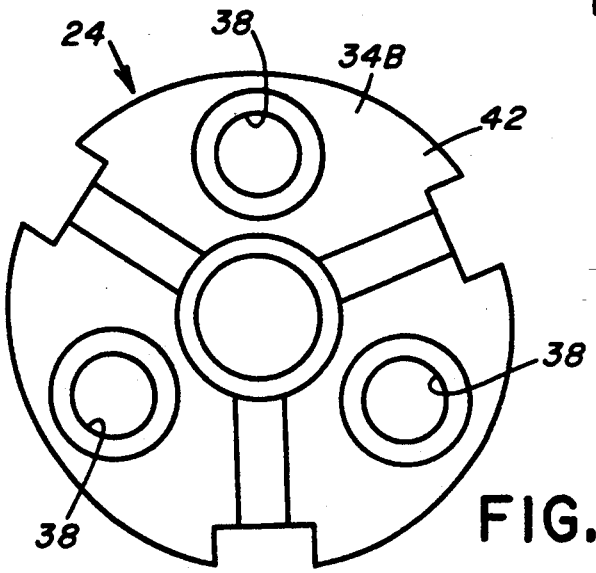
FIG. 5 is a bottom view of the intake flow control assembly as seen along line 5—5 of FIG. 4.

Referring to FIG. 6, the formation injection tool 10 also preferably includes an upper discharge flow control device 72 replacing the annular connector 62 between the lower tubular mandrel 44 of the upper intake flow control assembly 24 and the hollow body 58 of the middle seal mechanism 26. The upper discharge flow control device 72 includes a mandrel connector 74 and a spring-adjustable back pressure valve 76. The upper end of the mandrel connector 74 is threadably connected to the lower end 44B of the lower mandrel 44 of the intake flow control assembly 24. The lower end of the mandrel connector 74 is threadably connected to the upper end 58A of the elongated hollow body 58 of the seal mechanism 26. The adjustable back pressure valve 76 is threadably mounted within a central bore 78 of the mandrel connector 74 and has a fluid straining cage 80 attached to and extending axially upwardly from an upper end 76A thereof.

In the event that a lower disposal formation D is encountered having a lower pressure than the upper productive formation P, the presence of the adjustable back pressure valve 76 of the upper discharge flow control device 72 directly below the intake flow control assembly 24 will prevent the desired fluid (natural gas) from free flowing through the inlet flow control valves 46 and down through the middle seal mechanism 26 and lower discharge flow control device 28 into the lower pressure disposal formation D should all of the undesired fluid (water) in the lower annulus 30 of the well casing C be pumped away into the disposal formation D by the pump 12. The adjustable back pressure valve 76 can be preset to the desired amount of back-pressure prior to installation in the production casing C.

Preferably, an upper portion 58A of the elongated hollow body 58 of the seal mechanism 26 being disposed above the guiding member 66 takes the form of a tubing on-and-off tool which is operable by rotating the formation injection tool 10 to disconnect and allow pulling from the well W of the interconnected components of the formation injection tool 10 and the pump 12 extending above the "production packer" (which is the guiding member 66 and the expandable annular member 64 providing the closure seal 33). Such removal permits the performance of periodic maintenance and servicing of these components without disturbing the packer closure seal 33 so as to prevent any fluid from re-entering the well casing C from the lower disposal formation D.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A formation injection tool for use within a casing of a production well in conjunction with a pump having an upstroke and a downstroke and extending downwardly with the well casing past and below an upper productive formation of the production well, said formation injection tool comprising:

(a) an upper intake flow control assembly having a lower end and being attachable to a lower end of the pump within the well casing and being adapted, in response to the upstroke of the pump, to permit one-way flow of an undesired heavier fluid, such as water, from the upper productive formation downwardly within the well casing and into said upper intake flow control assembly concurrently as a desired lighter fluid, such as oil and/or gas, flows from the upper productive formation upwardly within the well casing to the ground surface;

(b) a middle seal mechanism located below and attached to said lower end of said upper intake flow control assembly below the pump, said seal mechanism being adapted to establish a closure seal in the well casing between the upper productive formation and a lower disposal formation of the production well; and (c) a lower discharge flow control device attached to said middle seal mechanism and located below said closure seal formed thereby, said lower discharge flow control device being connected in flow communciation with said lower end of said upper intake flow control assembly via said middle seal mechanism and, in response to the downstroke of the pump, being adapted to permit only one-way flow of the undesired heavier fluid from said intake assembly, downwardly through said seal mechanism, and from said lower discharge flow control device to the lower disposal formation of the production well being located below said closure seal formed by said middle seal mechanism.

2. The tool of claim 1 wherein said upper intake flow control assembly includes a main body having a pair of opposite upper and lower ends, a central bore defined in said main body extending axially therethrough between said upper and lower ends thereof, a plurality of inlet ports defined in said main body circumferentially spaced from one another about said central bore of said main body adjacent to said lower end thereof and spaced below said upper end thereof, and a plurality of flow passages defined in said main body extending from said respective inlet ports to said central bore thereof and being connected with said central bore at locations spaced above said lower end of said main body, said upper end of said main body being adapted for attachment to said lower end of said pump.

3. The tool of claim 2 wherein said upper intake flow control assembly also includes a plurality of inlet flow control valves coupled to said main body in flow communication with said inlet ports and flow passages so as to permit one-way flow of the undesired heavier fluid from the productive formation of the well located adjacent to or above said main body of said upper intake flow control assembly into said central bore thereof through said inlet ports and flow passages thereof.

4. The tool of claim 2 wherein said middle seal mechanism includes an elongated body having a pair of upper and lower opposite ends and a central flow passageway defined therethrough and extending between said upper and lower ends thereof, said upper end of said elongated body of said middle seal mechanism being connected to said lower end of said main body of said upper intake flow control assembly.

5. The tool of claim 4 wherein said middle seal mechanism also includes an expandable annular member attached to and disposed about the exterior of said elongated body and being adapted to expand and provide said closure seal in the well casing with an annular interior surface portion of the well casing being located between the upper productive formation and lower disposal formation of the well.

6. The tool of claim 5 wherein said middle seal mechanism further includes a guiding member attached to and disposed about the exterior of said elongated body adjacent to said expandable annular member and being adapted to guide said tool into the well casing during installation thereof in the well casing.

7. The tool of claim 4 wherein:

said upper intake flow control assembly also includes a plurality of inlet flow control valves coupled to said main body in flow communication with said inlet ports and flow passages so as to permit one-way flow of the undesired heavier fluid from the productive formation of the well located adjacent to or above said main body of said upper intake flow control assembly into said central bore thereof through said ports and flow passages thereof; and said lower discharge flow control device is connected to said lower end of said elongated body of said middle seal mechanism and in flow communication with said lower end of said main body of said upper intake flow control assembly so as to permit only one-way flow of the undesired fluid from said upper intake flow control assembly downwardly through said central passageway of said elongated body of said seal mechanism and from said discharge flow control device to the disposal formation located below said closure seal formed in the well casing by said middle seal mechanism such that, in response to the upstroke of the pump, the undesired heavier fluid is separated from the desired lighter fluid and drawn downwardly in the well casing and then through said inlet flow control valves and said inlet ports and flow passages of said main body of said upper intake flow control assembly into said central bore thereof and the pump from an annulus of the well surrounding the exterior of said intake flow control assembly, whereas, in response to the downstroke of the pump, the undesired heavier fluid in said upper intake flow control assembly and the pump is pushed downward through said central bore of said upper intake flow control assembly and outwardly through said lower end of said main body portion thereof, through said central passageway of said elongated body of said middle seal mechanism, and from said lower discharge flow control device for disposal of the undesired fluid in the disposal formation of the well, said lower discharge flow control device being adapted to prevent back flow of the undesired fluid therethrough and upwardly to said intake flow control assembly in response to the next upstroke of the pump.

8. The tool of claim 1 further comprising:

an upper discharge flow control device connected between said lower end of said upper intake flow control assembly and an upper end of said middle seal mechanism and being operable to produce a back-pressure sufficient to prevent free flow of desired fluid with undesired fluid from the well casing through said upper intake flow control assembly, downly through said middle seal mechanism and outwardly from said lower discharge flow control device into the lower disposal formation in the event that the pressure in the lower disposal formation is less than in the upper productive formation.

9. In a production well a formation injection tool used in conjunction with a pump having a hollow barrel stationarily mounted within a casing of the well and extending downwardly within the well casing below an upper productive formation of the well to a lower end of said hollow barrel and a plunger repetitively driven through an upstroke followed by a downstroke within said hollow barrel to carry out, in conjunction with said formation injection tool, first, gravitational separation of a desired lighter fluid, such as oil and/or gas, from an undesired heavier fluid, such as water, both emanating from the upper productive formation of the production well into the well casing and, second, transport of the separated undesired heavier fluid downwardly to and disposal thereof into a lower disposal formation of the well spaced below the upper disposal formation thereof, said formation injection tool comprising:

(a) an upper intake flow control assembly having a lower end and attached to said lower end of said barrel of said pump within the well casing and being adapted, in response to said upstroke of said plunger of said pump, to permit one-way flow of the undesired heavier fluid from the upper production formation downwardly within an annulus of the well casing surrounding said pump and said upper intake flow control assembly and therefrom into said upper intake flow control assembly concurrently as the desired lighter fluid flows from the upper productive formation upwardly within the well casing to the ground surface;

(b) a middle seal mechanism located below and attached to a lower end of said upper intake flow control assembly below said pump, said middle seal mechanism being adapted to establish a closure seal within the well casing between the upper productive formation and a lower disposal formation of the production well; and (c) a lower discharge flow control device attached to said middle seal mechanism and being located below said closure seal, said lower discharge flow control device being connected in flow communciation with said lower end of said upper intake flow control assembly via said seal mechanism and, in response to said downstroke of said pump, being adapted to permit only one-way flow of the undesired heavier fluid from said upper intake flow control assembly, downwardly through said middle seal mechanism, and from said lower discharge flow control device to the lower disposal formation of the production well being located below said closure seal formed by said middle seal mechanism.

10. The tool of claim 9 wherein said upper intake flow control assembly includes a main body having a pair of opposite upper and lower ends, a central bore defined in said main body extending axially therethrough between said upper and lower ends thereof, a plurality of inlet ports defined in said main body circumferentially spaced from one another about said central bore of said main body adjacent to said lower end thereof and spaced below said upper end thereof, and a plurality of flow passages defined in said main body extending from said respective inlet ports to said central bore thereof and being connected with said central bore at locations spaced above said lower end of said main body, said upper end of said main body being adapted for attachment to said lower end of said barrel of said pump.

11. The tool of claim 10 wherein said upper intake flow control assembly also includes a plurality of inlet flow control valves coupled to said main body in flow communication with said inlet ports and flow passages so as to permit one-way flow of the undesired heavier fluid from the productive formation of the well located adjacent to or above said main body of said upper intake flow control assembly into said central bore thereof through said inlet ports and flow passages thereof.

12. The tool of claim 10 wherein said middle seal mechanism includes an elongated body having a pair of upper and lower opposite ends and a central flow passageway defined therethrough and extending between said upper and lower ends thereof, said upper end of said elongated body of said middle seal mechanism being connected to said lower end of said main body of said upper intake flow control assembly.

13. The tool of claim 12 wherein said middle seal mechanism also includes an expandable annular member attached to and disposed about the exterior of said elongated body and being adapted to expand and provide said closure seal in the well casing with an annular interior surface portion of the well casing being located between the upper productive formation and lower disposal formation of the well.

14. The tool of claim 13 wherein said middle seal mechanism further includes a guiding member attached to and disposed about the exterior of said elongated body adjacent to said expandable annular member and being adapted to guide said tool into the well casing during installation thereof in the well casing.

15. The tool of claim 12 wherein:

said upper intake flow control assembly also includes a plurality of inlet flow control valves coupled to said main body in flow communication with said inlet ports and flow passages so as to permit one-way flow of the undesired heavier fluid from the productive formation of the well located adjacent to or above said main body of said upper intake flow control assembly into said central bore thereof through said inlet ports and flow passages thereof; and said lower discharge flow control device is connected to said lower end of said elongated body of said middle seal mechanism and in flow communication with said lower end of said main body of said upper intake flow control assembly so as to permit only one-way flow of the undesired fluid from said upper intake flow control assembly downwardly through said central passageway of said elongated body of said middle seal mechanism and from said lower discharge flow control device to the disposal formation located below said closure seal formed in the well casing by said middle seal mechanism such that, in response to the upstroke of the pump, the undesired heavier fluid is separated from the desired lighter fluid and drawn downwardly in the well casing and then through said inlet flow control valves and said inlet ports and flow passages of said main body of said upper intake flow control assembly into said central bore thereof and said chamber of said pump from an annulus of the well surrounding the exterior of said upper intake flow control assembly, whereas, in response to the downstroke of the pump, the undesired heavier fluid in said upper intake flow control assembly and the pump is pushed downward through said central bore of said upper intake flow control assembly and outwardly through said lower end of said main body portion thereof, through said central passageway of said elongated body of said middle seal mechanism, and from said lower discharge flow control device for disposal of the undesired fluid in the disposal formation of the well, said lower discharge flow control device being adapted to prevent back flow of the undesired fluid therethrough and upwardly to said upper intake flow control assembly in response to the next upstroke of the pump.

16. The tool of claim 9 further comprising:

an upper discharge flow control device connected between said lower end of said upper intake flow control assembly and an upper end of said middle seal mechanism and being operable to produce a back-pressure sufficient to prevent free flow of desired fluid with undesired fluid from the well casing through said upper intake flow control assembly, downly through said middle seal mechanism and outwardly from said lower discharge flow control device into the lower disposal formation in the event that the pressure in the lower disposal formation is less than in the upper productive formation.

17. An intake flow control assembly of a formation injection tool for use within a casing of a production well in conjunction with a pump, said intake flow control assembly comprising:

(a) a main body having a pair of opposite upper and lower ends, a central bore defined in said main body extending axially therethrough between said upper and lower ends thereof, a plurality of inlet ports defined in said main body circumferentially spaced from one another about said central bore of said main body adjacent to said lower end thereof and spaced below said upper end thereof, and a plurality of flow passages defined in said main body extending from said respective inlet ports to said central bore thereof and being connected with said central bore at locations spaced above said lower end of said main body, said upper end of said main body being adapted for attachment to a lower end of a pump; and (b) a plurality of inlet flow control valves coupled to said main body and disposed in flow communication with said inlet ports and flow passages thereof so as to permit one-way flow of the undesired heavier fluid from a productive formation of the well located adjacent to or above the exterior of said main body of said intake flow control assembly into said central bore thereof through said inlet ports and flow passages thereof.

18. The assembly of claim 17 wherein said main body includes an upper port head attached at an upper end to a lower end of the pump, said upper port head containing said inlet ports, said flow passages and a short upper section of said central bore.

19. The assembly of claim 18 wherein said main body also includes an elongated lower tubular mandrel containing most of said central bore of said main body, said mandrel having an upper end connected to a socket defined centrally in a lower end of said upper port head and a lower end connected to an upper end of said elongated hollow body of said middle seal member, said mandrel extending extending downwardly beyond said inlet ports defined on said lower end of said port head and disposed around said socket.

20. The assembly of claim 19 wherein each of said plurality of inlet flow control valves is connected in flow communication with one of said inlet ports in said upper port head, said inlet flow control valves being disposed around said mandrel and extend downwardly from said inlet ports generally parallel to said mandrel.

21. The assembly of claim 18 wherein each of said plurality of inlet flow control valves includes a valve cage defining a flow channel extending axially therethrough, an annular seat therein located between opposite ends of said flow channel, and a ball movably mounted in an upper portion of said flow channel defined above said seat to undergo axial movement between an upper opened unseated position and a lower closed seated position relative to said annular seat.

22. The assembly of claim 17 wherein each of said plurality of inlet flow control valves also includes a fluid straining cage connected to a bottom end of said valve cage and being adapted to strain out solid particles above a predetermined size in the undesired fluid and thus prevent such particles from entering said main body of said intake flow control assembly.

* * * * *